US009696093B2

(12) United States Patent
Laberge

(10) Patent No.: US 9,696,093 B2
(45) Date of Patent: Jul. 4, 2017

(54) BASEBOARD FOR USE IN PREHEATING WATER

(71) Applicant: Sylvain Laberge, Sainte-Therese (CA)

(72) Inventor: Sylvain Laberge, Sainte-Therese (CA)

( * ) Notice: Subject to any disclaimer, the term of this patent is extended or adjusted under 35 U.S.C. 154(b) by 205 days.

(21) Appl. No.: 14/576,376

(22) Filed: Dec. 19, 2014

(65) Prior Publication Data

US 2015/0226490 A1 Aug. 13, 2015

(30) Foreign Application Priority Data

Feb. 7, 2014 (GB) ..... 1402193.5

(51) Int. Cl.

| | |
|---|---|
| ***F28D 1/047*** | (2006.01) |
| ***E04F 19/00*** | (2006.01) |
| ***E04F 19/02*** | (2006.01) |
| ***F24H 1/00*** | (2006.01) |
| ***F28D 7/00*** | (2006.01) |
| ***F28D 1/02*** | (2006.01) |
| *E04F 19/04* | (2006.01) |

(52) U.S. Cl.

CPC ..... *F28D 1/0472* (2013.01); *E04F 19/00* (2013.01); *E04F 19/02* (2013.01); *F24H 1/00* (2013.01); *F28D 1/0233* (2013.01); *F28D 7/0016* (2013.01); *E04F 2019/044* (2013.01)

(58) Field of Classification Search

CPC ..... F28D 1/0246; F28D 1/0391; F28D 1/04; F24D 3/14; F24D 3/145; F24D 3/146; F24D 3/147; F24D 3/149

USPC ..... 165/47, 53–57, 177, 179; 237/43, 69

See application file for complete search history.

(56) References Cited

U.S. PATENT DOCUMENTS

| | | | | | |
|---|---|---|---|---|---|
| 2,269,578 | A | * | 1/1942 | Buti | F24D 3/16 165/55 |
| 2,848,199 | A | * | 8/1958 | Drewes, Jr. | F24D 19/04 165/120 |
| 3,244,223 | A | | 4/1966 | Edwards | |
| 3,261,964 | A | | 7/1966 | Groossinger | |
| 3,398,786 | A | * | 8/1968 | McNabney | F24D 19/04 165/55 |
| 3,408,479 | A | * | 10/1968 | Welch, Sr. | F24H 3/004 165/104.19 |
| 3,463,904 | A | * | 8/1969 | Pauls | F24H 3/004 165/104.19 |
| 3,472,313 | A | | 10/1969 | Milgram et al. | |

(Continued)

FOREIGN PATENT DOCUMENTS

| | | | |
|---|---|---|---|
| EP | 0035994 | * | 4/1984 |
| WO | WO8707703 | * | 12/1987 |

*Primary Examiner* — William Gilbert

(57) ABSTRACT

A baseboard for use in preheating water has a heating element having a plurality of heating surface areas, a continuous coiled pipe member having a plurality of 180 degree bends adapted and formed to cover at least one of the surface areas of the heating element. The pipe member include a cold water intake pipe at a first end and a warm water outflow pipe at a second end dedicated and adapted to send warm water to a water heater. A cover member adapted to cover the heating element and the coiled pipe member includes at least one opening therethrough adapted to allow air to pass through and circulate around the heating element and the coiled pipe member and create a convection effect capable of adding additional heat to the water while passing through the coiled pipe member.

7 Claims, 2 Drawing Sheets

(56) References Cited

U.S. PATENT DOCUMENTS

| | | | | |
|---|---|---|---|---|
| 3,759,320 | A | 9/1973 | Bullard | |
| 4,139,152 | A | 2/1979 | Kronberger, Jr. | |
| 4,484,564 | A * | 11/1984 | Erickson | F28D 21/0007 122/169 |
| 7,044,398 | B2 | 5/2006 | Sweet | |
| 8,347,950 | B2 | 1/2013 | Stroobants | |
| 2006/0056994 | A1 * | 3/2006 | Van Lear | F04D 25/04 417/407 |
| 2008/0029613 | A1 * | 2/2008 | Friedlich | F24D 19/04 237/59 |
| 2009/0151768 | A1 * | 6/2009 | Forseth | F24H 1/0045 136/207 |
| 2010/0084114 | A1 * | 4/2010 | Lawrence | F24D 19/04 165/53 |

* cited by examiner

FIG. 2a
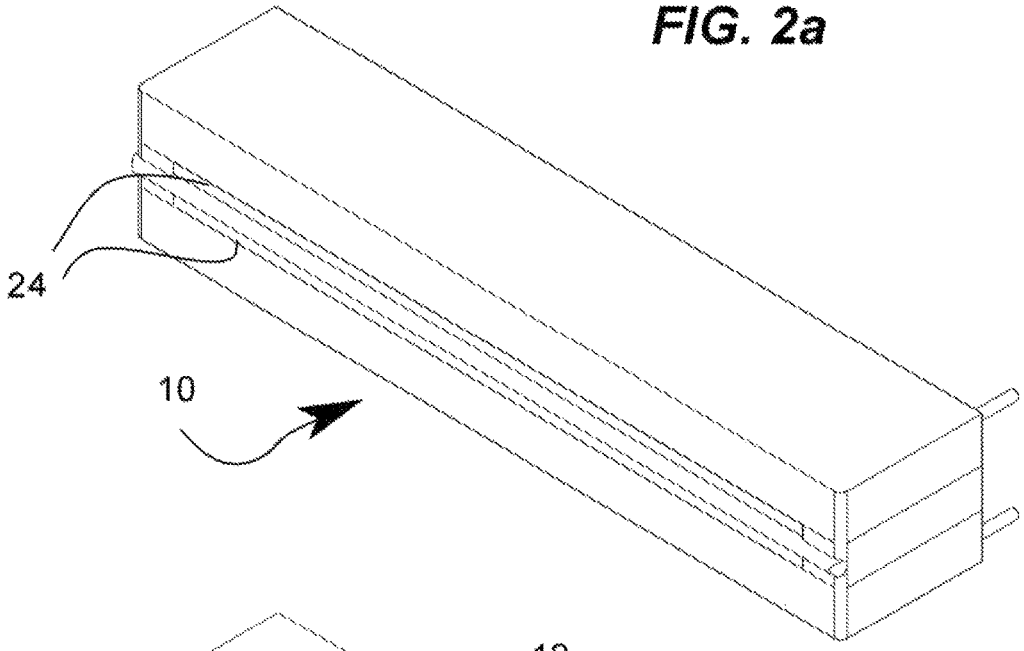
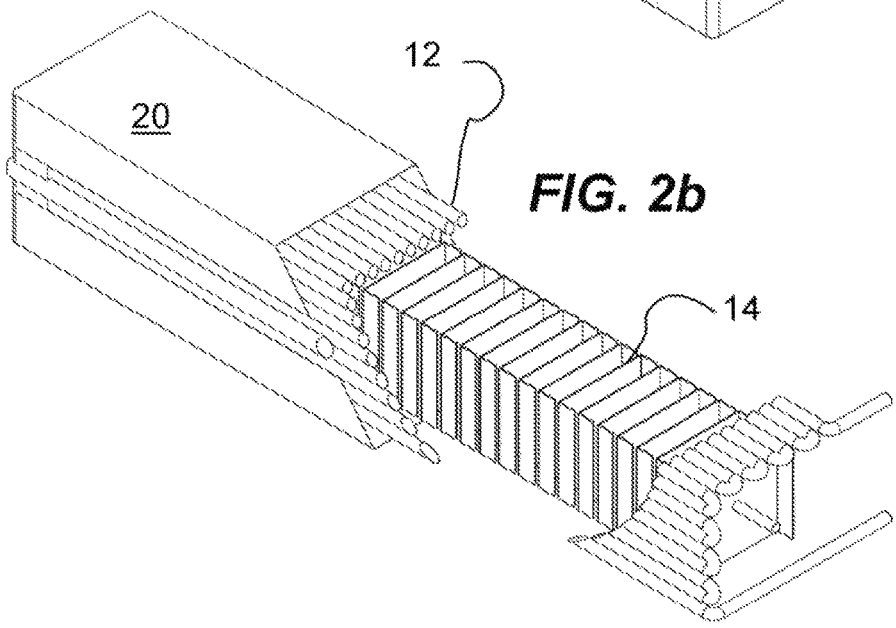
FIG. 2b

BASEBOARD FOR USE IN PREHEATING WATER

FIELD OF THE INVENTION

The present invention relates generally to water heating system but more particularly to a baseboard for use in preheating water.

BACKGROUND OF THE INVENTION

A water heater can be costly while it keeps water hot at all times. There are pre heating systems that allow for water to be preheated so as to reduce the cost associated with a water heater, whether electric, gas or oil.

SUMMARY OF THE INVENTION

It is a main advantage of this invention to provide for a simple water preheating system which combines with a baseboard heater.

It is another advantage of this invention to have the water circulating through the coil, so as to cool a room when the baseboard heater element is turned off and the ambient temperature is high, such as during hot summer months.

In order to do so, the invention consists in a heating element having a plurality of heating surface areas, a continuous coiled pipe member having a plurality of 180 degree bends adapted and formed to cover at least one of the surface areas of the heating element. The pipe member include a cold water intake pipe at a first end and a warm water outflow pipe at a second end dedicated and adapted to send warm water to a water heater. A cover member adapted to cover the heating element and the coiled pipe member includes at least one opening therethrough adapted to allow air to pass through and circulate around the heating element and the coiled pipe member and create a convection effect capable of adding additional heat to the water while passing through the coiled pipe member.

The baseboard has the coiled pipe member further include at least one bend that allows the coiled pipe member to cover a plurality of faces.

In a preferred embodiment, the continuous coiled pipe member covers at least two of the surface areas of the heating element.

There are preferably two openings through the cover member, thereby increasing the airflow of the air within the baseboard. The two openings extend parallel to one another a length of one side of the cover member.

The cover member and the at least one opening are linearly elongated.

In yet another embodiment, the cover member covers at least four sides of the heating element.

In still another embodiment, the heating element is formed in the shape of an elongated rectangular volume.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

BRIEF DESCRIPTION OF THE DRAWINGS

FIGS. 2*a-b* Isometric view of the invention and partial see through view of the invention.

DETAILED DESCRIPTION

Figure 1:
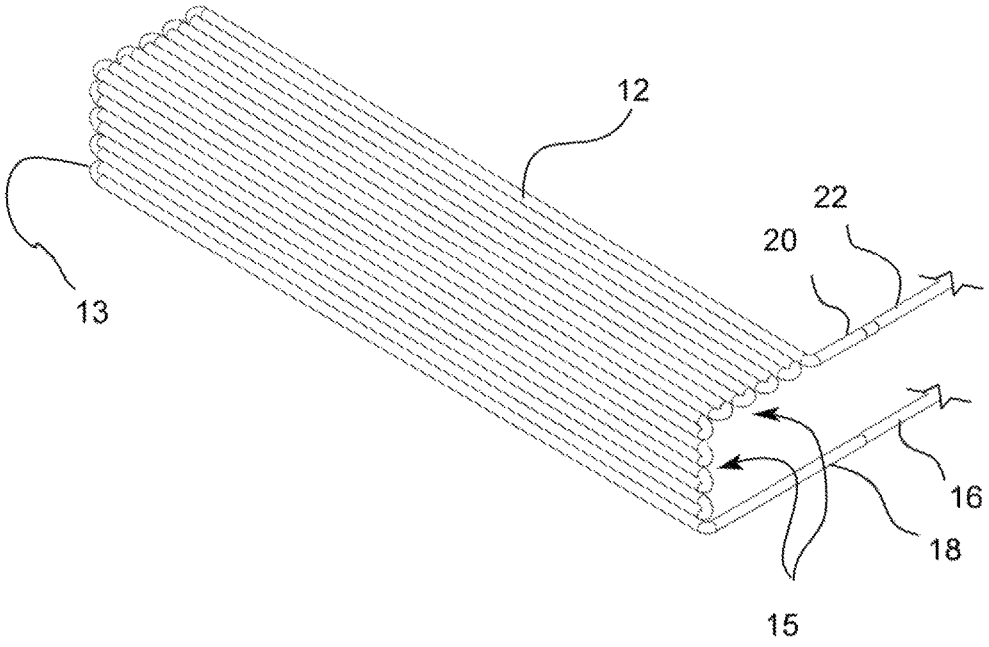
FIG. 1 Isometric view of a coiled pipe.

A baseboard (10) for use in preheating water has a single continuous coiled pipe member (12) having a plurality of 180 degree bends (13) so that it covers a plurality of faces (15) over and around the surface areas of a centrally located heating element (14) comprising six sides forming part of the baseboard (10) in the shape of an elongated rectangular volume. Water circulating through the coiled pipe (12) gets preheated before entering a regular tank water heater (not shown). A cover member (20) covers the pipe (12) as well as the heating element (14). Specially, the cover member is adapted to cover at least four sides of the heating element as well as the coiled pipe. At least one but preferably a pair of linearly elongated openings (24) in front of the cover (20) allows for air circulation to create a convection effect. The pair of linearly elongated openings extend parallel to one another at a length on one side of the cover member.

Cold water from a cold water intake pipe (16) enters a first end (18) of the coiled pipe (12) and exits at a second end (20) of the coiled pipe (12).

The water then goes directly into the water heater (not shown) by way of a dedicated warm water outflow pipe (22).

What is claimed is:

1. A combination of a water heater and a baseboard heater wherein said baseboard heater has a plurality of heating surface areas for preheating water for said water heater; said combination comprises a water heater; and a baseboard heater comprising a heating element; a continuous coiled pipe member having a plurality of 180 degree bends adapted and formed to cover at least one of said surface areas of said heating element, said pipe member including a cold water intake pipe at a first end and a warm water outflow pipe at a second end dedicated and adapted to send warm water to said water heater; and a cover member adapted to cover said heating element and said coiled pipe member, and including at least one opening therethrough adapted to allow air to pass through and circulate around said heating element and said coiled pipe member and create a convection effect capable of adding additional heat to said water while passing through said coiled pipe member.

2. The combination of claim 1, wherein said continuous coiled pipe member covers at least two of said surface areas of said heating element.

3. The combination of claim 1, wherein said at least one opening is two openings.

4. The combination of claim 3, wherein said two openings extend parallel to one another a length of one side of said cover member.

5. The combination of claim 1, wherein said cover member and said at least one opening are linearly elongated.

6. The combination of claim 1, wherein said cover member covers at least four sides of said heating element.

7. The combination of claim 1, wherein said heating element is formed in the shape of an elongated rectangular volume.

* * * * *